US006489073B2

(12) United States Patent
Kotsugai et al.

(10) Patent No.: US 6,489,073 B2
(45) Date of Patent: Dec. 3, 2002

(54) METHOD AND DEVICE FOR DEVELOPING ELECTROSTATIC LATENT IMAGES

(75) Inventors: Akihiro Kotsugai, Shizuoka (JP); Kimitoshi Yamaguchi, Shizuoka (JP); Hiroshi Ikuno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 15 days.

(21) Appl. No.: 09/758,196

(22) Filed: Jan. 12, 2001

(65) Prior Publication Data

US 2001/0028987 A1 Oct. 11, 2001

(30) Foreign Application Priority Data

Jan. 14, 2000 (JP) ..... 2000-007215

(51) Int. Cl.[7] ..... G03G 13/06; G03G 15/08
(52) U.S. Cl. ..... 430/97; 399/236; 399/265
(58) Field of Search ..... 430/97; 399/236, 399/265

(56) References Cited

U.S. PATENT DOCUMENTS 3,754,531 A * 8/1973 Donalies et al.
4,602,863 A * 7/1986 Fritz et al.
5,771,429 A * 6/1998 Oyama et al. ..... 399/260

* cited by examiner

*Primary Examiner*—Mark Chapman
(74) *Attorney, Agent, or Firm*—Oblon, Spivak, McClelland, Maier & Neustadt, P.C.

(57) ABSTRACT

Electrostatic latent images are developed with a toner in such a configuration that an electrostatic-latent-image-bearing member is disposed to face a developer-bearing member which bears thereon a developer consisting of a magnetic carrier and a toner by relatively moving the developer-bearing member and the electrostatic-latent-image-bearing member at different velocities, with the development being carried out under conditions represented by formula (1):

$$0.1\ \text{mm} \le k = L \cdot [(Vr/Vp) - 1] \le 2\ \text{mm} \quad (1)$$

wherein Vp is a transporting velocity (mm/sec) of the surface of the electrostatic-latent-image-bearing member, Vr is a transporting velocity (mm/sec) of the surface of the developer-bearing member, and L is a width (mm) of a contact portion between the developer and the electrostatic-latent-image-bearing member.

18 Claims, 1 Drawing Sheet

METHOD AND DEVICE FOR DEVELOPING ELECTROSTATIC LATENT IMAGES

BACKGROUND OF THE INVENTION

1. Field of the Invention

The present invention relates to a method and a device for developing electrostatic latent images.

2. Discussion of Background

The device for developing electrostatic latent images incorporated in the electrophotographic printers and copying machines has been investigated from various angles in order to improve the printing speed and image reproducibility. In particular, there is an increasing demand for the reproducibility of an image constituted of picture elements with high density to achieve high-speed printing and obtain high resolving power and resolution of the printed image.

In a development method using a two-component developer made of a magnetic carrier and a powdered toner, when the transporting velocity (Vp) of the surface of a latent-image-bearing member is increased to improve the printing speed, the period of time during which the developer passes the latent image formed on the latent-image-bearing member is necessarily curtailed, thereby producing many problems. For example, insufficient amount of developer lowers the image density, halftone images lack uniformity in image density, thin line images become broken, and the toner fails to transfer to a small-size dot image. In order to solve the above-mentioned problems, many trials have been made to increase the amount of developer that can be brought into contact with the latent images and to extend the period of time during which the developer is in contact with the latent images. For instance, it is proposed to increase the width (L) of a contact portion between the developer and the latent-image-bearing member, which will be hereinafter referred to as a development nip width or simply a nip width, and to increase the transporting velocity (Vr) of the developer-bearing member with respect to the transporting velocity (Vp) of the latent-image-bearing member. The above-mentioned width (L) is the width of a contact portion of the latent-image-bearing member with the developer in a direction of the transporting direction of the latent-image-bearing member.

However, it is known that extension of the contact time between the developer and the latent image at the nip width, which will be hereinafter referred to as a nip time, and increase in amount of the developer which comes in contact with the latent image bring about abnormal images. To be more specific about the abnormal images, the image density of a solid image area becomes lower at an end portion thereof in a transporting direction of the latent-image-bearing member, the toner fails to transfer to the end portion of a halftone image area, and the image density is changed at the boundary between the solid image area and the halftone image area. In other words, abnormal images tend to appear at the boundary of image density, that is, the boundary between the adjacent latent images differing in electric potential, and at the point where the electric potentials of latent images suddenly show a discontinuous change. Such abnormal images are considered to result from transient development. Namely, only a toner component is transferred from the developer to the latent-image-bearing member while the developer passes the development nip. While a layer of developer that is a dielectric member with an electrostatic capacity supported by the developer-bearing member passes through a discontinuous electric field for development, abnormal images are easily produced. Such abnormal images caused by the discontinuous potential in latent images will be referred to as defective images in the present invention.

In recent years, in line with the trend toward a small-size developer unit, there has been a tendency for reduction in size of the developer-bearing member and the latent-image-bearing member. Therefore, the diameters of the currently available developer-bearing member and the latent-image-bearing member in a cylindrical form are both reduced, whereby the curvature radius is reduced at a position where the developer-bearing member is brought into the immediate proximity of the latent-image-bearing member. The result is that the development nip width (L) necessarily decreases. Therefore, curtailment of the nip time easily decreases the amount of developer to be brought into contact with the latent-image-bearing member in a manner similar to that as mentioned above. For preventing this problem from happening, it is proposed to make a difference between the aforementioned transporting velocities Vp and Vr larger. In this case, however, the defective images are also induced.

SUMMARY OF THE INVENTION

It is therefore a first object of the present invention to provide a developing method which does not produce defective images such as image blurring and intermission in thin line images, but can produce images with sufficient image density and excellent resolving power as a whole, particularly, in thin line images and small-size dot images.

A second object of the present invention is to provide a developer unit for use with the above-mentioned developing method.

The first object of the present invention can be achieved by a method for developing electrostatic latent images in such a configuration that an electrostatic-latent-image-bearing member is disposed to face a developer-bearing member which bears thereon a developer comprising a magnetic carrier and a toner, the method comprising the step of relatively moving a surface of the developer-bearing member and a surface of the electrostatic-latent-image-bearing member at different velocities to develop the electrostatic latent images with the toner, wherein the development is carried out under conditions represented by formula (1):

$$0.1\ \text{mm} \le k = L\cdot[(Vr/Vp)-1] \le 2\ \text{mm} \qquad (1)$$

wherein Vp is a transporting velocity (mm/sec) of the surface of the electrostatic-latent-image-bearing member, Vr is a transporting velocity (mm/sec) of the surface of the developer-bearing member, and L is a width (mm) of a contact portion between the developer and the electrostatic-latent-image-bearing member.

The second object of the present invention can be achieved by a unit for developing electrostatic latent images comprising an electrostatic-latent-image-bearing member and a developer-bearing member which has a permanent magnet therein and bears thereon a developer comprising a magnetic carrier and a toner, wherein a surface of the developer-bearing member and a surface of the electrostatic-latent-image-bearing member are relatively moved at different velocities, and the electrostatic latent images are developed with the toner in such a configuration that the developer-bearing member is kept parallel to the electrostatic-latent-image-bearing member at a position where the developer-bearing member is located nearest to the electrostatic-latent-image-bearing member, with the development being carried out under conditions represented by formula (1):

$$0.1\ \text{mm} \le k = L \cdot [(Vr/Vp) - 1] \le 2\ \text{mm} \quad (1)$$

wherein Vp is a transporting velocity (mm/sec) of the surface of the electrostatic-latent-image-bearing member, Vr is a transporting velocity (mm/sec) of the surface of the developer-beating member, and L is a width (mm) of a contact portion between the developer and the electrostatic-latent-image-bearing member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
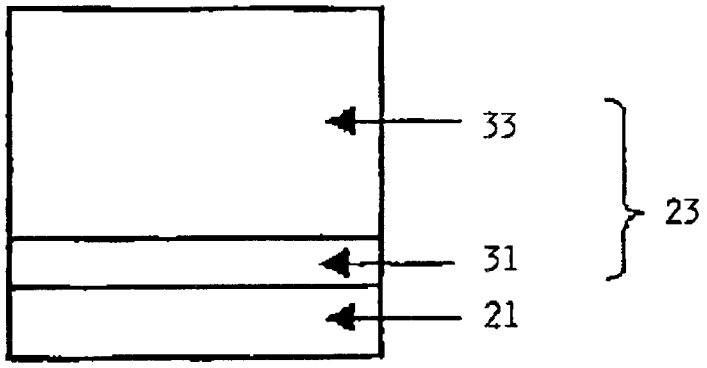
FIG. 1 is a schematic cross-sectional view showing one embodiment of a layered electrophotographic photoconductor for use in the present invention.

According to the present invention, development is carried out under the conditions represented by the previously mentioned formula (1). In formula (1), as the value represented by k is increasing, defective images tend to occur more frequently. When the value k exceeds 2 mm, defective images noticeably appear resulting from the decrease in image density at the boundary between the image portions differing in image density. As previously mentioned, such defective images occur at the boundaries of image density where the electric potentials of latent images discontinuously change in a traveling direction of the latent-image-bearing member. In particular, the defects become striking at the end portion of a halftone image area where a slight change of toner deposition amount can be noticeably recognized as the change in image density.

The velocity of the developer-bearing member is made different from that of the latent-image-bearing member. Namely, the developer moves more rapidly than the latent image within the development nip width. Therefore, the toner contained in the developer tends to become partial and the developer cannot immediately respond to the applied development field by the influence of change in potential of the latent images. The degree of occurrence of defective images depends upon the traveling amount of developer with respect to the latent images while the developer comes in slide contact with the latent images within the development nip width. In other words, the occurrence of defective images is determined by the distance k (mm) defined by $L \cdot [(Vr/Vp)-1]$ in formula (1). Basically, the defective image is considered to occur within a distance k (mm) represented by formula (1) from the boundary where the image density is changed. In light of this, the smaller the value k, the better the results. However, when the distance k is too small, sufficient image density may not be obtained. The distance k is set within the range of 0.1 to 2 mm in the present invention.

In formula (1), L is the contact width (mm) of the latent-image-bearing member with the developer. By removing a part of the developer unit including the development nip width, the contact width of the latent-image-bearing member with the developer can be easily measured in practice. Alternatively, the development nip width can be observed from the latent-image-bearing member side by incorporating a transparent cylinder or belt of the same configuration as that of the latent-image-bearing member into the developer unit. In any case, the contact portion between the latent-image-bearing member and the developer can be identified as a stripe area perpendicular to the traveling direction of the latent-image-bearing member. The width of the stripe area extending in the traveling direction of the latent-image-bearing member is defined as L in formula (1).

A latent-image-bearing member, that is, a member for bearing electrostatic latent images thereon for use with the development method of the present invention may be a layered photoconductor. When a charge transport layer (CTL) and a protective layer are successively provided on a charge generation layer (CGL), it is preferable to reduce the total thickness of the CTL and the protective layer. The reduction of the above-mentioned total thickness makes it possible not only to prevent the defective images from occurring, but also to improve the image density and the reproducibility of a thin line image and a small-size dot image. Such advantages can be obtained because the electrostatic capacities of the CTL and the protective layer provided thereon can be increased, so that the charge quantity of the electrostatic latent image formed on the surface of the photoconductor can be increased with respect to the potential of the photoconductor. As a result, it is considered that the amount of toner sufficient for development can be ensured even though the development time is shortened. During the development time, the charge of the latent image is neutralized by deposition of a toner thereon, and the intensity of developing field decreases with time. When the charge quantity of the latent image is increased, the descending rate of the developing field resulting from neutralization of the electric charge of the latent image becomes moderate. Therefore, the latent images can be efficiently developed with a toner even though the development time becomes shorter.

In addition, diffusion of the carrier in the CTL is one of the causes to impair the sharpness of the latent images in the layered photoconductor. Also to avoid the above-mentioned drawback, the total thickness of the CTL and the protective layer and other layers provided on the CTL may not extremely increase. A small-size dot image and the adjacent dot images can be thus developed with high resolving power. In the present invention, it is preferable that the total thickness of the charge transport layer and the outer layers provided thereon be in the range of 10 to 22 $\mu$m. when the total thickness exceeds 22 $\mu$m, the effect of increasing the charge quantity of latent images, which effect also depends on the dielectric constant of a material constituting each of the CTL or the outer layer, cannot be expected. The result is that the amount of toner sufficient for development cannot be ensured. On the other hand, when the total thickness is less than 10 $\mu$m, the electric field within the photoconductive layer of the layered photoconductor becomes too strong, so that dielectric breakdown occurs in a part of the photoconductive layer, thereby easily causing defective spotted images.

As the latent-image-bearing member for use in the present invention, any conventional members are available. In particular, a layered photoconductor is preferable as mentioned above.

Figure 2:
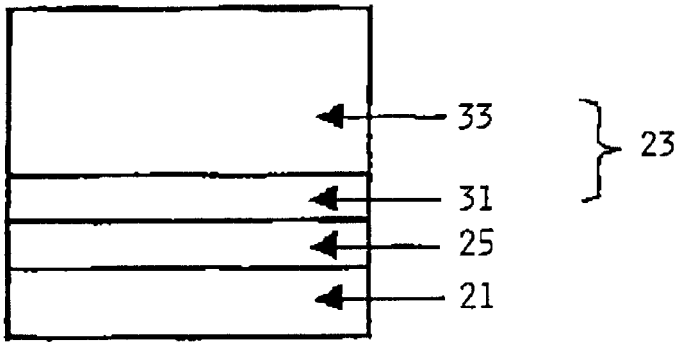
FIG. 2 is a schematic cross-sectional view showing another embodiment of a layered electrophotographic photoconductor for use in the present invention.
Figure 3:
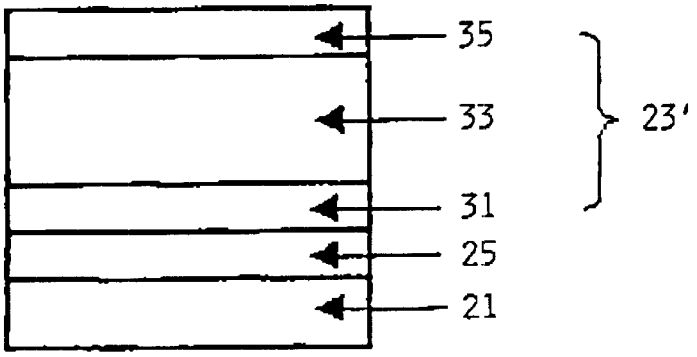
FIG. 3 is a schematic cross-sectional view showing still another embodiment of a layered electrophotographic photoconductor for use in the present invention.

FIG. 1, FIG. 2 and FIG. 3 are schematic cross-sections showing embodiments of layered photoconductors for use in the present invention.

In FIG. 1, a charge generation layer 31 and a charge transport layer 33, which constitute a function-separating photoconductive layer 23, are provided on an electroconductive support 21 in this order.

As shown in FIG. 2, the same function-separating photoconductive layer 23 as in FIG. 1 is provided on an electroconductive support 21 via an undercoat layer 25.

In a photoconductor of FIG. 3, a charge generation layer 31, a charge transport layer 33, and a protective layer 35 constitute a function-separating photoconductive layer 23'. Those layers are successively overlaid on an electroconductive support 21 via an undercoat layer 25.

Any photoconductor is usable in the present invention as long as a photoconductive layer is provided on an electroconductive support. The additional layers and the type of photoconductive layer may be appropriately selected.

As the electroconductive support for use in the layered photoconductor, electroconductive materials are usable, and electrically insulating materials may be treated to be electroconductive. To be more specific, metals such as Al, Fe, Cu, Au, and alloys thereof are usable as it is, and an electrically insulating support made of, for example, polyester, polycarbonate, polyimide, or glass may be coated with a thin film of a metal such as Al, Ag or Au, or an electroconductive material such as $In_2O_3$ or $SnO_2$. Further, a sheet of paper treated to be electroconductive is usable. The shape of the electroconductive support is not particularly limited, but the support may be prepared into the form of a plate, drum, or belt.

The undercoat layer is provided in order to improve the adhesion of the photoconductive layer to the electroconductive support, prevent the occurrence of moiré, improve the coating performance of the photoconductive layer, and reduce the residual potential.

The undercoat layer comprises a resin as the main component. The photoconductive layer is usually provided on the undercoat layer by coating method using a solvent, so that it is desirable that the resin for use in the undercoat layer have high resistance against generally used organic solvents.

Preferable examples of the resin for use in the undercoat layer include water-soluble resins such as poly(vinyl alcohol), casein, and sodium polyacrylate; alcohol-soluble resins such as copolymer nylon and methoxymethylated nylon; and hardening resins with three-dimensional network such as polyurethane, melamine resin, alkyd-melamine resin, and epoxy resin.

The undercoat layer may further comprise finely-divided particles of metallic oxides such as titanium oxide, silica, alumina, zirconium oxide, tin oxide, and indium oxide; metallic sulfides; and metallic nitrides.

The undercoat layer can be provided on the electroconductive support by the conventional coating method, using an appropriate solvent.

The undercoat layer for use in the present invention may be a metallic oxide layer prepared by the sol-gel processing using a coupling agent such as silane coupling agent, titanium coupling agent, or chromium coupling agent.

Furthermore, to prepare the undercoat layer, $Al_2O_3$ may be deposited on the electroconductive support by anodizing process, or an organic material such as poly-para-xylylene (parylene), or inorganic materials such as SiO, $SnO_2$, $TiO_2$, ITO, and $CeO_2$ may be vacuum-deposited on the electroconductive support.

It is preferable that the thickness of the undercoat layer be in the range of 0 to 5 $\mu$m.

The layered photoconductive layer 23 as shown in FIG. 1 to FIG. 3 comprises a charge generation layer 31 and a charge transport layer 33. The charge generation layer 31 will be first explained in detail.

The charge generation layer 31 comprises a charge generation material, optionally in combination with a binder resin. The charge generation material includes an inorganic material and an organic material.

Specific examples of the inorganic charge generation material are crystalline selenium, amorphous selenium, selenium-tellurium, selenium-tellurium-halogen, selenium-arsenic compound, and a-silicon (amorphous silicon). In particular, when the above-mentioned a-silicon is employed as the charge generation material, it is preferable that the dangling bond be terminated with a hydrogen atom or a halogen atom, or be doped with boron atom or phosphorus atom.

Specific examples of the conventional organic charge generation materials for use in the present invention are phthalocyanine pigments such as metallo-phthalocyanine and metal-tree phthalocyanine, azulenium salt pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryl oxadiazole skeleton, azo pigments having a distyryl carbazole skeleton, perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoid pigments, and bisbenzimidazole pigments.

Those charge generation materials may be used alone or in combination.

Among the above-mentioned charge generation materials, phthalocyanine pigments with a phthalocyanine skeleton are preferable because the charge generation layer can be inhibited from being corroded in the presence of ozone and $NO_x$ generated by charging in the apparatus, and in addition, the phthalocyanine pigments excel in photosensitivity. In particular, metallophthalocyanine, especially oxotitanium phthalocyanine is most preferable. Furthermore, the phthalocyanine may have a Y-type crystalline structure.

Examples of the binder resin for use in the charge generation layer are polyamide, polyurethane, epoxy resin, polyketone, polycarbonate, silicone resin, acrylic resin, poly(vinyl butyral), poly(vinyl formal), poly(vinyl ketone), polystyrene, poly-N-vinylcarbazole, and polyacrylamide. Those binder resins may be used alone or in combination.

The charge generation layer may further comprise a low-molecular charge transport material.

The above-mentioned low-molecular charge transport material that can be contained in the charge generation layer includes a positive hole transport material and an electron transport material.

Examples of the electron transport material for use in the charge generation layer include conventional electron acceptor compounds such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, and 1,3,7-trinitrodibenzothiophene-5,5-dioxide. Those electron transport materials may be used alone or in combination.

Examples of the positive hole transport material for use in the charge generation layer include electron donor compounds such as oxazole derivatives, oxadiazole derivatives, imidazole derivatives, triphenylamine derivatives, 9-(p-diethylaminostyryl anthracene), 1,1-bis-(4-dibenzylaminophenyl)propane, styryl anthracene, styryl pyrazoline, phenylhydrazone, α-phenylstilbene derivatives, thiazole derivatives, triazole derivatives, phenazine derivatives, acridine derivatives, benzofuran derivatives, benzimidazole derivatives, and thiophene derivatives. Those positive hole transport materials may be used alone or in combination.

The charge generation layer can be formed by vacuum thin-film forming method or casting method using a dispersion system.

The vacuum thin-film forming method includes vacuum deposition, glow discharge, ion plating, sputtering, reactive sputtering, and chemical vapor deposition (CVD). The above-mentioned inorganic and organic charge generation materials are applicable to the vacuum thin-film forming method.

When the charge generation layer is formed by the casting method, the above-mentioned inorganic or organic charge generation material, optionally in combination with a binder agent, is dispersed in a proper solvent such as tetrahydrofuran, cyclohexanone, dioxane, dichloroethane, or butanone in a ball mill, an attritor or a sand mill. The dispersion thus obtained may be appropriately diluted to prepare a coating liquid for charge generation layer. The coating of the coating liquid for the charge generation layer 31 is achieved by dip coating, spray coating, or beads coating.

The proper thickness of the charge generation layer thus formed is in the range of about 0.01 to about 5 μm, preferably in the range of 0.05 to 2 μm.

The charge transport layer will now be explained in detail.

The charge transport layer serves to (1) retain an electric charge thereon which is obtained by a charging step, and (2) couple a charge which is generated in the charge generation layer and transported to the charge transport layer by a light exposure step with the charge obtained by the charging step. The charge transport layer is required to have high electrical resistivity to attain the above-mentioned function (1). In addition to this, a small dielectric constant and good charge mobility are also required to obtain a high surface potential of the charge transport layer using the electric charge retained. Further, the charge transport layer is required to have high wear resistance, more specifically, the resistance against various kinds of mechanical load, such as contact with peripheral members, development with a toner, contact with a sheet of paper, and contact with a cleaning brush or blade.

The charge transport layer comprises a charge transport material, optionally in combination with a binder resin so as to satisfy the above-mentioned requirements. The charge transport material, optionally in combination with the binder resin, may be dissolved or dispersed in a proper solvent to prepare a coating liquid for charge transport layer. The coating liquid thus prepared may be coated and dried. When necessary, the charge transport layer coating liquid may further comprise proper amounts of a plasticizer, an antioxidant, and a leveling agent.

The charge transport material for use in the charge transport layer includes a positive hole transport material and an electron transport material.

Examples of the electron transport material for use in the charge transport layer are conventional electron acceptor compounds such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno [1,2-b]thiophen-4-one, and 1,3,7-trinitrodibenzothiophene-5,5-dioxide. Those electron transport materials may be used alone or in combination.

Examples of the positive hole transport material for use in the charge transport layer include electron donor compounds such as oxazole derivatives, oxadiazole derivatives, imidazole derivatives, triphenylamine derivatives, 9-(p-diethylaminostyryl anthracene), 1,1-bis-(4-dibenzylaminophenyl)propane, styryl anthracene, styryl pyrazoline, phenylhydrazone, α-phenylstilbene derivatives, thiazole derivatives, triazole derivatives, phenazine derivatives, acridine derivatives, benzofuran derivatives, benzimidazole derivatives, and thiophene derivatives. Those positive-hole transport materials may be used alone or in combination.

It is preferable that the total thickness of the charge transport layer and the layers provided thereon such as a protective layer be in the range of about 5 to about 100 μm, more preferably in the range of about 10 to about 22 μm.

The commercially available antioxidants for rubbers, plastic materials, and fats and oils may be contained in the charge transport layer.

Furthermore, the charge transport layer may further comprise a plasticizer in order to improve the environmental resistance, more specifically, to prevent the decrease of sensitivity and charging characteristics. The plasticizer may be contained in any layer comprising an organic material. In particular, addition of the plasticizer to the charge transport layer can produce satisfactory results.

As the leveling agent for use in the charge transport layer coating liquid, there can be employed silicone oils such as dimethyl silicone oil, and methylphenyl silicone oil, and polymers and oligomers having a perfluoroalkyl group on the side chain thereof. The proper amount of leveling agent is in the range of 0 to about one part by weight with respect to 100 parts by weight of the binder resin for use in the charge transport layer.

When a protective layer is provided on the charge transport layer as shown in FIG. 3, the protective layer works to protect the charge transport layer from abrasion caused by mechanical loads, such as contact with the peripheral members, development with a toner, contact with a sheet of paper, and contact with a cleaning brush or blade. Therefore, the protective layer is required to have a higher hardness than the charge transport layer, and a high electric resistivity to retain the electric charge in a similar way to that of the charge transport layer. In light of the purposes of the protective layer, a resin having a higher hardness is dissolved or dispersed in a proper solvent to prepare a coating liquid for protective layer, and the coating liquid is coated and dried. The coating layer may be further chemically cured when necessary.

The protective layer may further comprise a charge transport layer, and in addition, a plasticizer, antioxidant, and a leveling agent in proper amounts for the same purposes as mentioned above in the description of the charge transport layer.

In order to improve the wear resistance of the protective layer, other additives with high hardness, for example, finely-divided particles of metallic oxides such as alumina, silica and titanium oxide, and abrasives such as silicon carbide may be internally added to the protective layer coating liquid. In this case, it is preferable to employ as the binder resin for the protective layer the same resin as employed in the charge transport layer because the wear resistance of the protective layer can be improved and the adhesion between the protective layer and the charge transport layer can be increased. When the finely-divided rigid particles are internally added to the protective layer coating liquid, an emulsifier, a dispersant, and a surfactant may also be contained when necessary to uniformly disperse the above-mentioned rigid particles in the protective layer.

The thickness of the protective layer, which is not particularly limited, may preferably be 10 $\mu$m or less, more preferably 3 $\mu$m or less.

The developer-bearing member will now be explained in detail.

It is desirable that the developer-bearing member provide the latent-image-bearing member with a toner at a high density. Preferably, the developer-bearing member may support the toner thereon at a density of 0.01 g/cm$^2$ or more when the developer-bearing member is located nearest to the latent-image-bearing member.

The density of toner per unit area of the developer-bearing member can be measured by the following method. For instance, development is carried out in such a manner that an area where no toner is deposited is formed on the latent-image-bearing member. The operation of the developer unit is forcibly stopped in the middle of the development. The latent-image-bearing member is taken out of the developer unit so as not to damage the condition of the development nip of the latent-image-bearing member. Thereafter, by collecting the developer deposited on the latent-image-bearing member at an area A (cm$^2$) which is appropriately fixed within the contact portion between the latent-image-bearing member and the developer-bearing member, the toner amount B (g) contained in the collected developer is measured. The ratio of B/A is obtained and defined as the above-mentioned density per unit area.

When a two-component developer is applied to the present invention, the toner is required to be densely supplied to the latent-image-bearing member. For this purpose, it is preferable that the carrier for use in the two-component developer have a volume mean diameter of 70 $\mu$m or less. When flexible magnetic particles such as magnetite, ferrite, and iron powder, or the above-mentioned magnetic particles coated with other materials are employed as the carrier particles, the density of toner that can be supplied to the latent-image-bearing member is unfavorably decreased when the volume mean diameter of the carrier particles exceeds 70 $\mu$m.

There can be employed various conventional materials for a core of the carrier particles. For example, ferromagnetic materials such as iron and cobalt, and magnetite, hematite, Li based ferrite, Mn—Zn based ferrite, Cu—Zn based ferrite, Ni—Zn based ferrite, and Ba based ferrite are usable as the core materials. The above-mentioned magnetic particles are usually employed as the core particles, and in addition, resin-dispersion carrier particles are also be preferably employed. The resin-dispersion carrier particles are constructed in such a manner that small-size magnetic particles are dispersed in conventional resins such as phenolic resin, acrylic resin, and polyester resin.

It is preferable that the carrier particles be covered with a material of which surface energy is low to prevent the materials constituting the toner from being adsorbed and attached to the surface of carrier particles, and reduce the adsorption of water content in the air.

Specific examples of the coating materials with a low surface energy include the conventional materials such as polytetrafluoroethylene (PTFE), perflucroalkoxy resin (PFA), tetrafluoroethylene-hexafluoropropylene copolymer (FEP), ethylene-tetrafluoroethylene (ETFE), polychlorotrifluoroethylene (PCTFE), polyvinylidene fluoride (PVDF), polyvinyl fluoride (PVF), polyimide resin, polycarbonate resin, styrene resin, and acrylic resin. Those materials may be used alone or in combination.

In particular, silicone polymers and hydrophobic materials using the silicone polymer, each having a repeat unit of Si—O are preferably used for a surface coating layer of the carrier particles. Silicone resins represented by the following formulas can be given as preferable examples of the silicone compounds with a repeat unit of Si—O.

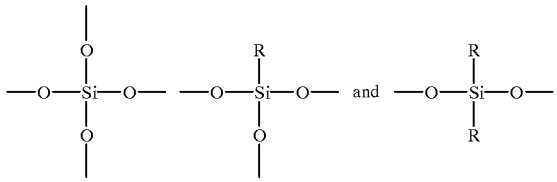

wherein R is a hydrogen atom, a halogen atom, hydroxyl group, methoxy group, a lower alkyl group having 1 to 4 carbon atoms, or phenyl group.

There are many commercially available straight-silicone resins, for example, "KR271", "KR272", "KR282", "KR252", "KR255", and "KR152" (trademarks of Shin-Etsu Chemical Co., Ltd.); and "SR2400" and "SR2406" (trademarks of Dow Corning Toray Silicone Co., Ltd.). Further, modified silicone resins, for example, epoxy-modified silicone, acryl-modified silicone, phenol-modified silicone, urethane-modified silicone, polyester-modified silicone, and alkyd-modified silicone are also usable. As such modified silicone resins, there are commercially available epoxy-modified silicone "ES-1001N", acryl-modified silicone "KR-5208", polyester-modified silicone "KR-5203", alkyd-modified silicone "KR-206", and urethane-modified silicone "KR-305" (trademarks of Shin-Etsu Chemical Co., Ltd.); and epoxy-modified silicone "SR2115" and alkyd-modified silicone "SR2110" (trademarks of Dow Corning Toray Silicone Co., Ltd.).

The surface coating layer of the carrier particles may further comprise a silane coupling agent to improve the dispersion properties and compatibility of the silicone resin with other additives.

A silane coupling agent represented by the following formula (2) is preferable. In particular, an aminosilane coupling agent of formula (2) wherein X includes amino group is especially preferable.

$$X—Si(OR)_n \tag{2}$$

wherein X represents a functional group having reactivity and adsorptivity with an organic or inorganic material, or a saturated or unsaturated hydrocarbon chain including the functional group; OR represents an alkoxyl group; and n is an integer of 1 to 3.

The following compounds can be used as the aminosilane coupling agents for use in the present invention:

| | |
|---|---|
| $H_2N(CH_2)_3Si(OCH_3)_3$ | (MW: 179.3) |
| $H_2N(CH_2)_3Si(OC_2H_5)_3$ | (MW: 221.4) |
| $H_2NCH_2CH_2CH_2Si(CH_3)_2-OC_2H_5$ | (MW: 161.3) |
| $H_2NCH_2CH_2CH_2Si(CH_3)(OC_2H_5)_2$ | (MW: 191.3) |
| $H_2NCH_2CH_2NHCH_2Si(OCH_3)_2-OCH_3$ | (MW: 194.3) |
| $H_2NCH_2CH_2NHCH_2CH_2CH_2Si(CH_3)(OCH_3)_2$ | (MW: 206.4) |
| $H_2NCH_2CH_2NHCH_2CH_2CH_2Si(OCH_3)_2-OCH_3$ | (MW: 224.4) |
| $(CH_3)_2NCH_2CH_2CH_2Si(CH_3)(OC_3H_5)_2$ | (MW: 219.4) |
| $(C_4H_9)_2NC_3H_6Si(OCH_3)_2-OCH_3$ | (MW: 291.6) |

For the purpose of adjusting the resistivity and enhancing the strength of the surface coating layer, the surface coating layer of the carrier particles may further comprise the following materials: metal powders such as electroconductive ZnO and Al, $SnO_2$ prepared by various methods and $SnO_2$ doped with a variety of elements, a variety of borides such as $TlB_2$, $ZnB_2$ and $MoB_2$, and silicon carbide, and electroconductive polymeric materials such as polyacetylene, poly(p-phenylene), and poly(p-phenylene sulfide), polypyrrole, and carbon black. In this case, one or more kinds may be appropriately used in proper amounts.

The surface coating resin layer of the carrier particles can be formed by the conventional methods such as spray drying, dipping, and powder coating.

The toner for use in the present invention comprises a thermoplastic resin as the binder resin. A coloring agent, a charge control agent, and a releasant are added to the above-mentioned binder resin. Using the above-mentioned components, a toner for use in the present invention can be prepared by the conventional preparation methods, for example, pulverizing method and polymerization method.

Specific examples of the binder resin for use in the toner are vinyl resins including homopolymers of styrene and substituted styrenes such as polystyrene and polyvinyltoluene, styrene-based copolymers such as styrene-p-chlorostyrene copolymer, styrene-propylene copolymer, styrene-vinyltoluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylmethyl ether copolymer, styrene-vinylmethyl ketone copolymer, styrene-butadiene copolymer, styrene-isoprene copolymer, styrene-maleic acid copolymer, and styrene-maleic acid ester copolymer, and poly(methyl methacrylate), poly(butyl methacrylate), poly(vinyl chloride), poly(vinyl acetate), and poly(vinyl butyral); and other resins such as polyethylene, polypropylene, polyester, polyurethane, epoxy resin, rosin, modified rosin, terpene resin, phenolic resin, aliphatic hydrocarbon resin, aromatic petroleum resin, paraffin chlorinated, and paraffin wax.

More specifically, the above-mentioned polyester resin can be prepared by polycondensation of an alcohol and an acid.

Examples of the alcohol for preparation of the polyester resin include diols such as polyethylene glycol, diethylene glycol, triethylene glycol, 1,2-propylene glycol, 1,3-propylene glycol, 1,4-propylene glycol, neopentyl glycol, and 1,4-butenediol; etherified bisphenols such as 1,4-bis(hydroxymethyl)cyclohexane, bisphenol A, hydrogenated bisphenol A, a reaction product of polyoxyethylene and bisphenol A, and a reaction product of polyoxypropylene and bisphenol A; dihydric alcohol monomers of the above-mentioned alcohols having a substituent such as a saturated or unsaturated hydrocarbon group with 3 to 22 carbon atoms; other dihydric alcohol monomers; and polyhydric alcohol monomers having three or more hydroxyl groups, such as sorbitol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of the acids for the preparation of polyester resin include monocarboxylic acids such as palmitic acid, stearic acid, and oleic acid; dicarboxylic acid monomers such as maleic acid, fumaric acid, mesaconic acid, citraconic acid, terephthalic acid, cyclohexane-dicarboxylic acid, succinic acid, adipic acid, sebacic acid, and malonic acid, each of which may have as a substituent a saturated or unsaturated hydrocarbon group having 3 to 22 carbon atoms; anhydrides of the above-mentioned acids; dimers of a lower alkyl ester and linolenic acid; polycarboxylic acid monomers such as 1,2,4-benzenetricarboxylic acid, 1,2,5-benzenetricarboxylic acid, 2,5,7-naphthalenetricarboxylic aid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, and 1,2,7,8-octanetetracarboxylic acid; and anhydrides of the above acids.

As the coloring agent for use in the toner, the conventional pigments and dyes can be employed. Specific examples of the coloring agent are carbon black, Lamp Black, iron black, ultramarine, nigrosine dye, Aniline Blue, Phthalocyanine Blue, Hansa Yellow X, Rhodanine 6G Lake, Chalco Oil Blue, Chrome Yellow, quinacridone, Benzidine Yellow, Rose Bengale, triarylmethane dye, monoazo dye and pigment, and disazo dye and pigment.

Those conventional dyes and pigments can be employed alone or in combination.

The toner for use in the present invention may further comprise a charge control agent, as mentioned above, in order to control the triboelectric charging properties.

Specific examples of the charge control agent include metal complex salts of monoazo dye, nitrohumic acid and salts thereof, salicylic acid, naphthoic acid, metal (Co, Cr, Fe or the like) complexes of dicarboxylic acid, amino-containing compounds, quaternary ammonium compounds, and organic dyes.

A releasant may be contained in the toner when necessary. Examples of the releasant include low molecular weight polypropylene, low molecular weight polyethylene, carnauba wax, microcrystalline wax, jojoba wax, rice wax, and montan wax. These materials may be used alone or in combination.

Further, finely-divided rigid particles may be added to the toner composition to impart proper fluidity to the toner. For example, metallic oxide particles surface-treated to be hydrophobic, such as conventionally known silica particles, titanium oxide particles, and aluminum oxide particles are effective. The above-mentioned metallic oxide particles may be doped with other metal elements. Further, composite particles prepared by coating the above-mentioned metallic oxide particles with different kinds of metallic oxides, and metallic oxide particles containing a plurality of metals are usable for improving the fluidity of toner.

It is preferable that the above-mentioned finely-divided particles have a hydrophobic surface in view of the improvement of fluidity and the retention of electric charge, The surface of the metallic oxide particles can be freely made hydrophobic by use of a siloxane, halogenated silicon-containing compound, alkoxysilane containing compound, silazane, silicone oil, and surface adsorbent. More specifically, as the agents for such surface treatment, there are silazanes such as hexamethyl disilazane, and alkylalkoxysilanes such as methyltrimethoxysilane, isobutyltrimethoxysilane, and trimethoxyfluoropropylsilane. These agents may be used alone or in combination.

For the same purposes as mentioned above, organic rigid resin particles can also be preferably used. For instance, resin particles prepared by emulsion polymerization or soap-free emulsion polymerization can become rigid particles with uniform particle size by adjustment of the composition or cross-linking structure. Such organic resin particles can be used as an agent for improving the fluidity of toner. Those organic resin particles may be surface-treated to be hydrophobic in a similar manner to that of the above-mentioned inorganic metallic oxide particles.

Other features of this invention will become apparent in the course of the following description of exemplary embodiments, which are given for illustration of the invention and are not intended to be limiting thereof.

PREPARATION EXAMPLE 1

[Fabrication of Photoconductor No. 1]

(Formation of Undercoat Layer)

A coating liquid with the following formulation was coated on the outer surface of an aluminum drum with an outer diameter of 30 mm, and dried. Thus, an undercoat layer with a thickness of about 4.0 $\mu$m was provided on the aluminum drum.

| | Parts by Weight |
|---|---|
| Alkyd resin (Trademark "Beckolite 1M6003-60", made by Dainippon Ink & Chemicals, Incorporated) | 6 |
| Melamine resin (Trademark "Super Beckamine G-821-60", made by Dainippon Ink & Chemicals, Incorporated) | 4 |
| Titanium oxide ("CR-EL" made by Ishihara Sangyo Kaisha, Ltd.) | 10 |
| Methyl ethyl ketone | 200 |

[Formation of Charge Generation Layer]

A coating liquid with the following formulation was coated on the above prepared undercoat layer by dip coating, and dried at 70° C. for 10 minutes. Thus, a charge generation layer with a thickness of 1 $\mu$m was provided on the undercoat layer.

| | Parts by Weight |
|---|---|
| Oxotitanium phthalocyanine pigment (charge generation material) | 5 |
| Poly(vinyl butyral) (Trademark "XYHL", made by Union Carbide Japan K.K.) | 2 |
| Tetrahydrofuran | 80 |

[Formation of Charge Transport Layer]

A coating liquid with the following formulation was coated on the above prepared charge generation layer by dip coating, and dried. Thus, a charge transport layer with a thickness of about 18 $\mu$m on a dry basis was provided on the charge generation layer.

| | Parts by Weight |
|---|---|
| Bisphenol Z type polycarbonate | 9 |
| Low-molecular weight charge transport material with the following formula: | 10 |

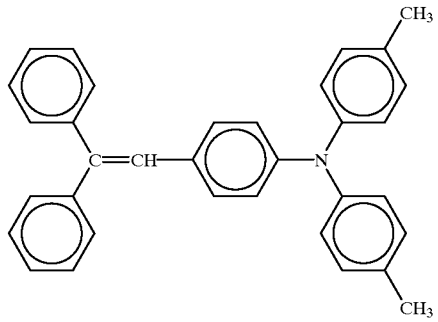

| | |
|---|---|
| Tetrahydrofuran | 100 |

Thus, an electrophotographic photoconductor No. 1 for use in the present invention was fabricated.

PREPARATION EXAMPLE 2

[Fabrication of Photoconductor No. 2]

The procedure for fabrication of the photoconductor No. 1 in Preparation Example 1 was repeated except that the thickness of the charge transport layer on a dry basis was changed from 18 to 12 μm. Thus, a photoconductor No. 2 for use in the present invention was fabricated.

PREPARATION EXAMPLE 3

[Fabrication of Photoconductor No. 3]

The procedure for fabrication of the photoconductor No. 1 in Preparation Example 1 was repeated except that the thickness of the charge transport layer on a dry basis was changed from 18 to 25 μm. Thus, a photoconductor No. 3 for use in the present invention was fabricated.

PREPARATION EXAMPLE 4

[Fabrication of Photoconductor No. 4]

The procedure for fabrication of the photoconductor No. 1 in Preparation Example 1 was repeated except that the thickness of the charge transport layer on a dry basis was changed from 18 to 8 μm. Thus, a photoconductor No. 4 for use in the present invention was fabricated.

PREPARATION EXAMPLE 5

[Preparation of Carrier (A)]

A commercially available carbon black (Trademark "Ketjen Black EC-DJ600", made by Lion Akzo Co., Ltd.) was added to a silicone resin (Trademark "SR2411", made by Dow Corning Toray Silicone Co., Ltd.) in such an amount that the amount of the carbon black might be 30 wt. % of the entire weight of the solid content of the silicone resin. The resultant mixture was dispersed in a ball mill for 10 minutes, and the obtained dispersion was diluted so as to have a solid content of 5 wt. %.

Core particles (A) (shown below) in an amount of 5 kg were coated with the above obtained silicone resin dispersion using a fluidized bed coating apparatus at a rate of about 50 g/min in an atmosphere of 100° C. The resin coated particles were dried at 250° C. for 2 hours, whereby a carrier (A) having a surface coating resin layer with a thickness of 0.5 μm was obtained. The thickness of the surface coating resin layer was controlled to 0.5 μm by adjusting the amount of the above-mentioned silicone resin dispersion subjected to fluidized bed coating. The volume mean diameter of the carrier (A) was 68 μm.

The characteristics of the core particles (A) were as follows:

Material=ferrite particles

Resistivity (LogΩcm)=10.3

Magnetic moment σs=65emu/g

Volume mean diameter=65 μm

PREPARATION EXAMPLES 6 AND 7

[Preparation of Carrier (B) and Carrier (C)]

The procedure for preparation of the carrier (A) in Preparation Example 5 was repeated except that the core particles (A) used in Preparation Example 5 were respectively replaced by core particles (B) and core particles (C) in Preparation Examples 6 and 7.

The volume mean diameters of the obtained carriers (B) and (C) were respectively 42 μm and 83 μm.

The characteristics of the core particles (B) were as follows:

Material particles=ferrite particles

Resistivity (LogΩcm)=9.8

Magnetic moment σs=85emu/g

Volume mean diameter=40 μm

The characteristics of the core particles (C) were as follows:

Material particles=magnetite particles

Resistivity (LogΩcm)=10.4

Magnetic moment σs=65 emu/g

Volume mean diameter=80 μm

The resistivity of the core particles (A), (B) and (C) was measured in such a manner that a cell was filled with the core particles, the cell being provided with electrodes parallel with each other having a distance of 2 mm therebetween. By the application of a voltage of 500 V across the electrodes, a direct current resistance was measured using a commercially available measuring instrument "4329A HighResistanceMeter" (Trademark), made by Hewlett-Packard Japan, Ltd.

The magnetic moment of the core particles was measured by the application of a magnetic field of 1000 Oe using a commercially available rotating extraction magnetometer "REM-1–10" (Trademark) made by TOEI INDUSTRY Co., Ltd.

The volume mean diameter of core particles was measured by "Microtrac Particle Size Analyzer (Model 7991-3) ", made by Leeds and Northrup Co., Ltd.

EXAMPLE 1

In a commercially available copying machine "imagio MF200" (Trademark), made by Ricoh Company, Ltd., the magnetized width of a magnet of a developer-bearing roller was controlled so as to have a value L of 0.6 mm in formula (1) when the developer-bearing roller was located nearest to the latent-image-bearing member. In this copying machine, Vp was set at 90 mm/sec, Vr was set at 225 mm/sec, and k, that is, the value obtained from formula of $L\cdot((Vr/Vp)-1))$ was 0.9 mm.

Five parts by weight of a commercially available toner (Trademark "imagio toner type 5" made by Ricoh Company, Ltd.) were mixed with 95 parts by weight of the silicon-resin-coated carrier C prepared in Preparation Example 7, whereby a two-component developer was obtained. The two-component developer was set in a developer unit of the copying machine. The copying machine was provided with the photoconductor No. 1 fabricated in Preparation Example 1.

With the developer unit being replenished with the toner, 10,000 copies were continuously made using a character-image-bearing test chart occupying character images at a ratio of 6%.

After completion of the running test, the character images obtained were evaluated in terms of the following items.

1. Reproducibility of Thin Line:

A one-dot lattice line image was outputted under the conditions of 600 dot/inch and 150 line/inch in both the main scanning direction and the sub-scanning direction. The obtained lines were visually evaluated whether the lines became broken or blurred. The evaluation was carried out on four levels. The evaluation criterion is as follows:

◎ excellent

○ good

Δ slightly poor (acceptable for practical use)

X very poor (not acceptable for practical use)

2. Resolving Power:

One-dot images were independently outputted under the conditions of 600 dot/inch and 300 line/inch in both the main scanning direction and the sub-scanning direction. The obtained dot images were visually evaluated from the viewpoints of absence of a dot and unevenness of image density. The reproducibility of dot images was observed as an indication of the resolving power. The evaluation was carried out on four levels. The evaluation criterion is as follows:

◎ excellent

○ good

Δ slightly poor (acceptable for practical use)

X very poor (not acceptable for practical use)

3. Defective Image:

Copies of an image-bearing chart in which a halftone portion (1 cm×1 cm) with an image density of 0.2 and a halftone portion (1 cm×1 cm) with an image density of 0.8 were alternately arranged side by side in the transporting direction of paper were outputted. The decrease in image density at the end of each halftone portion was visually inspected. The above-mentioned image density was measured using a Macbeth reflection type densitometer. The evaluation was carried out on four levels. The evaluation criterion is as follows:

◎ excellent

○ good

Δ slightly poor (acceptable for practical use)

X very poor (not acceptable for practical use)

4. Saturated Image Density:

A solid image was outputted, and the image density of the solid image was measured at arbitrary three positions using the above-mentioned Macbeth densitometer. The average of the image density was obtained.

◎ 1.4 or more (excellent)

○ 1.3 to 1.4 (good)

Δ 1.2 to 1.3 (slightly poor)

X less than 1.2 (very poor, and not acceptable for practical use)

The evaluation results are shown in TABLE 1.

EXAMPLE 2

In a commercially available copying machine "imagio MF200" (Trademark), made by Ricoh Company, Ltd., the magnetized width of a magnet of a developer-bearing roller was controlled so as to have a value L of 0.6 mm in formula (1) when the developer-bearing roller was located nearest to the latent-image-bearing member. In this copying machine, Vp was set at 90 mm/sec, Vr was set at 225 mm/sec, and k, that is, the value obtained from formula of L·((Vr/Vp)−1)) was 0.9 mm.

Five parts by weight of a commercially available toner (Trademark "imagio toner type 5" made by Ricoh Company, Ltd.) were mixed with 95 parts by weight of the silicon-resin-coated carrier C prepared in Preparation Example 7, whereby a two-component developer was obtained. The two-component developer was set in a developer unit of the copying machine. The copying machine was provided with the photoconductor No. 3 fabricated in Preparation Example 3.

Image evaluation was performed in the same manner as in Example 1 after 10,000 copies were continuously made.

The evaluation results are shown in TABLE 1.

EXAMPLE 3

In a commercially available copying machine "imagio MF200" (Trademark), made by Ricoh Company, Ltd., the magnetized width of a magnet of a developer-bearing roller was controlled so as to have a value L of 0.6 mm in formula (1) when the developer-bearing roller was located nearest to the latent-image-bearing member. In this copying machine, Vp was set at 90 mm/sec, Vr was set at 225 mm/sec, and k, that is, the value obtained from formula of L·( (Vr/Vp)−1)) was 0. 9 mm.

Five parts by weight of a commercially available toner (Trademark "imagio toner type 5" made by Ricoh Company, Ltd.) were mixed with 95 parts by weight of the silicon-resin-coated carrier C prepared in Preparation Example 7, whereby a two-component developer was obtained. The two-component developer was set in a developer unit of the copying machine. The copying machine was provided with the photoconductor No. 4 fabricated in Preparation Example 4.

Image evaluation was performed in the same manner as in Example 1 after 10,000 copies were continuously made.

The evaluation results are shown in TABLE 1.

EXAMPLE 4

In a commercially available copying machine "imagio MF200" (Trademark), made by Ricoh Company, Ltd., the magnetized width of a magnet of a developer-bearing roller was controlled so as to have a value L of 1.2 mm in formula (1) when the developer-bearing roller was located nearest to the latent-image-bearing member. In this copying machine, Vp was set at 90 mm/sec, Vr was set at 225 mm/sec, and k, that is, the value obtained from formula of L·((Vr/Vp)−1)) was 1.68 mm.

Five parts by weight of a commercially available toner (Trademark "imagio toner type 5" made by Ricoh Company, Ltd.) were mixed with 95 parts by weight of the silicon-resin-coated carrier C prepared in Preparation Example 7, whereby a two-component developer was obtained. The two-component developer was set in a developer unit of the copying machine. The copying machine was provided with the photoconductor No. 1 fabricated in Preparation Example 1.

Image evaluation was performed in the same manner as in Example 1 after 10,000 copies were continuously made.

The evaluation results are shown in TABLE 1.

EXAMPLE 5

In a commercially available copying machine "imagio MF200" (Trademark), made by Ricoh Company, Ltd., the magnetized width of a magnet of a developer-bearing roller was controlled so as to have a value L of 0.6 mm in formula (1) when the developer-bearing roller was located the nearest to the latent-image-bearing member. In this copying machine, Vp was set at 90 mm/sec, Vr was set at 135 mm/sec, and k, that is, the value obtained from formula of L·((Vr/Vp)−1)) was 0.3 mm.

The same two-component developer and the same photoconductor No. 1 fabricated in Preparation Example 1 as employed in Example 1 were set in the copying machine.

Image evaluation was performed in the same manner as in Example 1 after 10,000 copies were continuously made.

The evaluation results are shown in TABLE 1.

EXAMPLE 6

In a commercially available copying machine "imagio MF200" (Trademark), made by Ricoh Company, Ltd., the magnetized width of a magnet of a developer-bearing roller was controlled so as to have a value L of 0.6 mm in formula (1) when the developer-bearing roller was located nearest to the latent-image-bearing member. In this copying machine, Vp was set at 90 mm/sec, Vr was set at 225 mm/sec, and k, that is, the value obtained from formula of L·((Vr/Vp)−1)) was 0.9 mm.

Five parts by weight of a commercially available toner (Trademark "imagio toner type 5" made by Ricoh Company, Ltd.) were mixed with 95 parts by weight of the silicon-resin-coated carrier C prepared in Preparation Example 7, whereby a two-component developer was obtained. The two-component developer was set in a developer unit of the copying machine. The copying machine was provided with the photoconductor No. 2 fabricated in Preparation Example 2.

Image evaluation was performed in the same manner as in Example 1 after 10,000 copies were continuously made.

The evaluation results are shown in TABLE 1.

EXAMPLE 7

In a commercially available copying machine "imagio MF200" (Trademark), made by Ricoh Company, Ltd., the magnetized width of a magnet of a developer-bearing roller was controlled so as to have a value L of 0.6 mm in formula (1) when the developer-bearing roller was located nearest to the latent-image-bearing member. In this copying machine, Vp was set at 90 mm/sec, Vr was set at 225 mm/sec, and k, that is, the value obtained from formula of L·((Vr/Vp)−1)) was 0.9 mm.

Five parts by weight of a commercially available toner (Trademark "imagio toner type 5" made by Ricoh Company, Ltd.) were mixed with 95 parts by weight of the silicon-resin-coated carrier C prepared in Preparation Example 7, whereby a two-component developer was obtained. The two-component developer was set in a developer unit of the copying machine. The copying machine was provided with the photoconductor No. 2 fabricated in Preparation Example 2.

Image evaluation was performed in the same manner as in Example 1 after 10,000 copies were continuously made.

The evaluation results are shown in TABLE 1.

EXAMPLE 8

In a commercially available copying machine "imagio MF200" (Trademark), made by Ricoh Company, Ltd., the magnetized width of a magnet of a developer-bearing roller was controlled so as to have a value L of 0.6 mm in formula (1) when the developer-bearing roller was located nearest to the latent-image-bearing member. In this copying machine, Vp was set at 90 mm/sec, Vr was set at 225 mm/sec, and k, that is, the value obtained from formula of L·(Vr/Vp)−1)) was 0.9 mm.

Seven parts by weight of a commercially available toner (Trademark "imagio toner type 5" made by Ricoh Company, Ltd.) were mixed with 93 parts by weight of the silicon-resin-coated carrier A prepared in Preparation Example 5, whereby a two-component developer was obtained. The two-component developer was set in a developer unit of the copying machine. The copying machine was provided with the photoconductor No. 1 fabricated in Preparation Example 1.

Image evaluation was performed in the same manner as in Example 1 after 10,000 copies were continuously made.

The evaluation results are shown in TABLE 1.

EXAMPLE 9

In a commercially available copying machine "imagio MF200" (Trademark), made by Ricoh Company, Ltd., the magnetized width of a magnet of a developer-bearing roller was controlled so as to have a value L of 0.6 mm in formula (1) when the developer-bearing roller was located nearest to the latent-image-bearing member. In this copying machine, Vp was set at 90 mm/sec, Vt was set at 225 mm/sec, and k, that is, the value obtained from formula of L·((Vr/Vp)−1)) was 0.9 mm.

Ten parts by weight of a commercially available toner (Trademark "imagio toner type 5" made by Ricoh Company, Ltd.) were mixed with 90 parts by weight of the silicon-resin-coated carrier B prepared in Preparation Example 6, whereby a two-component developer was obtained. The two-component developer was set in a developer unit of the copying machine. The copying machine was provided with the photoconductor No. 1 fabricated in Preparation Example 1.

Image evaluation was performed in the same manner as in Example 1 after 10,000 copies were continuously made.

The evaluation results are shown in TABLE 1.

EXAMPLE 10

In a commercially available copying machine "imagio MF200" (Trademark), made by Ricoh Company, Ltd., the magnetized width of a magnet of a developer-bearing roller was controlled so as to have a value L of 0.6 mm in formula (1) when the developer-bearing roller was located nearest to the latent-image-bearing member. In this copying machine, Vp was set at 90 mm/sec, Vr was set at 225 mm/sec, and k, that is, the value obtained from formula of L·((Vr/Vp)−1) ) was 0.9 mm.

Ten parts by weight of a commercially available toner (Trademark "imagio toner type 5" made by Ricoh Company, Ltd.) were mixed with 90 parts by weight of the silicon-resin-coated carrier B prepared in Preparation Example 6, whereby a two-component developer was obtained. The two-component developer was set in a developer unit of the copying machine, The copying machine was provided with the photoconductor No. 1 fabricated in Preparation Example 1.

Image evaluation was performed in the same manner as in Example 1 after 10,000 copies were continuously made.

The evaluation results are shown in TABLE 1.

COMPARATIVE EXAMPLE 1

In a commercially available copying machine "imagio MF200" (Trademark), made by Ricoh Company, Ltd., the magnetized width of a magnet of a developer-bearing roller was controlled so as to have a value L of 2 mm in formula (1) when the developer-bearing roller was located nearest to the latent-image-bearing member. In this copying machine, Vp was set at 90 mm/sec, Vr was set at 225 mm/sec, and k, that is, the value obtained from formula of L·( (Vr/Vp)−1)) was 3.0 mm.

Five parts by weight of a commercially available toner (Trademark "imagio toner type 5" made by Ricoh Company, Ltd.) were mixed with 95 parts by weight of the silicon-resin-coated carrier C prepared in Preparation Example 7, whereby a two-component developer was obtained. The two-component developer was set in a developer unit of the copying machine. The copying machine was provided with the photoconductor No. 1 fabricated in Preparation Example 1.

Image evaluation was performed in the same manner as in Example 1 after 10,000 copies were continuously made.

The evaluation results are shown in TABLE 1.

COMPARATIVE EXAMPLE 2

In a commercially available copying machine "imagio MF200" (Trademark), made by Ricoh Company, Ltd., the magnetized width of a magnet of a developer-bearing roller was controlled so as to have a value L of 0.3 mm in formula (1) when the developer-bearing roller was located nearest to the latent-image-bearing member. In this copying machine, Vp was set at 90 mm/sec, Vr was set at 108 mm/sec, and k, that is, the value obtained from formula of L·((Vr/Vp)−1)) was 0.06 mm.

Five parts by weight of a commercially available toner (Trademark "imagio toner type 5" made by Ricoh Company, Ltd.) were mixed with 95 parts by weight of the silicon-resin-coated carrier C prepared in Preparation Example 7, whereby a two-component developer was obtained. The two-component developer was set in a developer unit of the copying machine. The copying machine was provided with the photoconductor No. 1 fabricated in Preparation Example 1.

Image evaluation was performed in the same manner as in Example 1 after 10,000 copies were continuously made.

The evaluation results are shown in TABLE 1.

TABLE 1

| | Photo-conduc-tor No. | Carrier | Value k (mm) | Toner Density (*) (g/cm$^2$) | Reproduci-bility of Thin Line | Resolv-ing Power | Defec-tive Image | Satu-rated ID |
|---|---|---|---|---|---|---|---|---|
| Ex. 1 | 1 | C | 0.9 | 0.008 | ○ | ○ | ○ | Δ |
| Ex. 2 | 3 | C | 0.9 | 0.009 | Δ | Δ | Δ | Δ |
| Ex. 3 | 4 | C | 0.9 | 0.01 | ○ | ◎ | ○ | ◎ |
| Ex. 4 | 1 | C | 1.8 | 0.008 | Δ | ○ | Δ | ○ |
| Ex. 5 | 1 | C | 0.3 | 0.008 | Δ | ○ | ○ | Δ |
| Ex. 6 | 2 | C | 0.9 | 0.007 | ◎ | ◎ | ○ | Δ |
| Ex. 7 | 2 | C | 0.9 | 0.012 | ◎ | ◎ | ○ | ○ |
| Ex. 8 | 1 | A | 0.9 | 0.021 | ◎ | ○ | ◎ | ○ |
| Ex. 9 | 1 | B | 0.9 | 0.028 | ◎ | ◎ | ◎ | ◎ |
| Ex. 10 | 1 | B | 0.9 | 0.031 | ◎ | ◎ | ◎ | ◎ |
| Comp. Ex. 1 | 1 | C | 3 | 0.008 | Δ | Δ | X | ○ |
| Comp. Ex. 2 | 1 | C | 0.06 | 0.009 | ○ | Δ | X | X |

(*) Toner deposition on the surface of a developer-bearing member at a position where the developer-bearing member is located nearest to the photoconductor.

As previously explained, latent images can be developed with excellent resolution according to the present invention. Even though the development nip time is short, and the amount of developer in contact with the latent-image-bearing member is small, occurrence of defective images can be prevented, while images with sufficient image density can be produced. In particular, the reproducibility of a thin line image is excellent, and a small-size dot image can be uniformly reproduced.

Japanese Patent Application No. 2000-007215 filed Jan. 14, 2000 is hereby incorporated by reference.

What is claimed is:

1. A method comprising moving a surface of a developer-bearing member and a surface of an electrostatic latent-image-bearing member at different velocities to develop one or more electrostatic latent images with a developer, wherein said electrostatic image bearing member is configured to face said developer-bearing member, wherein a developer comprising a magnetic carrier and a toner is presented one said surface of said developer-bearing member, and wherein said development is carried out under conditions represented by formula (1):

$$0.1\ \text{mm} \le k = L\cdot[(Vr/Vp)-1] \le 2\ \text{mm} \quad (1)$$

wherein Vp is a transporting velocity (mm/sec) of said surface of said electrostatic-latent-image-bearing member, Vr is a transporting velocity (mm/sec) of said surface of said developer-bearing member and L is a width (mm) of acontact portion between said developer and said electrostatic-latent-image-bearing member.

2. The method as claimed in claim 1, wherein said electrostatic-latent-image-bearing member is a layered electrophotographic photoconductor.

3. The method as claimed in claim 2, wherein said layered electrophotographic photoconductor comprises a charge transport layer and a protective layer provided thereon, with the total thickness of said charge transport layer and said protective layer being in a range of 10 to 22 $\mu$m.

4. The method as claimed in claim 2, wherein said developer-bearing member supports said toner thereon at a density of 0.01 g/cm$^2$ or more at a position where said developer-bearing member is located nearest to said electrostatic-latent-image-bearing member.

5. The method as claimed in claim 2, wherein said carrier has a volume mean diameter of 70 $\mu$m or less.

6. The method as claimed in claim 2, wherein said carrier comprises a surface layer comprising a silicone polymer which comprises a repeat unit of Si—O.

7. The method of claim 1, wherein Vr is 225 mm/sec and Vp is 90 mm/sec.

8. The method of claim 1, wherein the toner is present on the developer-bearing member at a density of 0.021 g/cm$^2$ or more.

9. The method of claim 1, wherein the toner is a two component toner.

10. A unit for developing electrostatic latent images comprising:

an electrostatic-latent-image-bearing member and a developer-bearing member which has a permanent magnet therein and bears thereon a developer comprising a magnetic carrier and a toner, wherein a surface of said developer-bearing member and a surface of said electrostatic-latent-image-bearing member are moved at different velocities, wherein said electrostatic latent images are developed with a developer, and wherein said developer-bearing member is comfigured parallel to said electrostatic-latent-image-bearing member at a position where said developer-bearing member is located nearest to said electrostatic-latent-image-bearing member, with said development carried out under conditions represented by formula (1):

$$0.1 \text{ mm} \leq k = L \cdot [(Vr/Vp) - 1] \leq 2 \text{ mm} \quad (1)$$

wherein Vp is a transporting velocity (mm/sec) of said surface of said electrostatic-latent-image-bearing member, Vr is a transporting velocity (mm/sec) of said surface of said developer-bearing member and L is a width (mm) of a contact portion between said developer and said electrostatic-latent-image-bearing member.

11. The unit as claimed in claim 10, wherein said electrostatic-latent-image-bearing member is a layered electrophotographic photoconductor.

12. The unit as claimed in claim 11, wherein said layered delectrophotographic photoconductor comprises a charge transport layer and a protective layer provided thereon, with the total thickness of said charge transport layer and said protective layer being in a range of 10 to 22 $\mu$m.

13. The unit as claimed in claim 11, wherein said developer-bearing member supports said toner thereon at a density of 0.01 g/cm$^3$ or more at a position wherein said developer-bearing member is located nearest to said electrostatic-latent-image-bearing member.

14. The unit as claimed in claim 11, wherein said carrier has a volume mean diameter of 70 $\mu$m or less.

15. The unit as claimed in claim 11, wherein said carrier comprises a surface layer comprising a silicone polymer which comprises a repeat unit of Si-O.

16. The unit of claim 10, wherein Vr is 225 mm/sec and Vp is 90 mm/sec.

17. The unit of claim 10, wherein the toner is present on the developer-bearing member at a density of 0.021 g/cm$^2$ or more.

18. The unit of claim 10, wherein the toner is a two component toner.

* * * * *

UNITED STATES PATENT AND TRADEMARK OFFICE

CERTIFICATE OF CORRECTION

PATENT NO. : 6,489,073 B2
DATED : December 3, 2002
INVENTOR(S) : Kimitoshi Yamaguchi et al.

It is certified that error appears in the above-identified patent and that said Letters Patent is hereby corrected as shown below:

Column 3,
Line 12, “beating” should read -- bearing --.

Column 4,
Line 56, “when” should read -- When --.

Column 12,
Line 62, “Yellow X” should read -- Yellow G --.

Column 18,
Line 29, “1.68 mm” should read -- 1.8 mm --.

Column 23,
Line 22, “claim 11” should read -- claim 10 --.

Signed and Sealed this

Twenty-ninth Day of July, 2003

JAMES E. ROGAN
*Director of the United States Patent and Trademark Office*